US010472737B2

(12) United States Patent
Torres Martinez

(10) Patent No.: US 10,472,737 B2
(45) Date of Patent: Nov. 12, 2019

(54) EXTRUSION HEAD FOR GENERATING FILAMENTS, EXTRUSION INSTALLATION AND METHOD USING SAID EXTRUSION HEAD

(71) Applicant: Manuel Torres Martinez, Pamplona (ES)

(72) Inventor: Manuel Torres Martinez, Pamplona (ES)

( * ) Notice: Subject to any disclaimer, the term of this patent is extended or adjusted under 35 U.S.C. 154(b) by 536 days.

(21) Appl. No.: 15/190,719

(22) Filed: Jun. 23, 2016

(65) Prior Publication Data

US 2016/0376728 A1 Dec. 29, 2016

(30) Foreign Application Priority Data

Jun. 25, 2015 (ES) ..... 2015-30911

(51) Int. Cl.

| | |
|---|---|
| ***D01D 4/02*** | (2006.01) |
| ***D01D 5/06*** | (2006.01) |
| ***D01D 10/04*** | (2006.01) |
| ***D01D 4/06*** | (2006.01) |
| ***D01D 7/00*** | (2006.01) |
| ***D01D 13/00*** | (2006.01) |

(52) U.S. Cl.

CPC ..... *D01D 5/06* (2013.01); *D01D 4/02* (2013.01); *D01D 4/06* (2013.01); *D01D 7/00* (2013.01); *D01D 10/0436* (2013.01); *D01D 10/0463* (2013.01); *D01D 13/00* (2013.01); *D10B 2321/10* (2013.01)

(58) Field of Classification Search

CPC .. D01D 1/02; D01D 1/06; D01D 5/06; D01D 7/00; D01D 10/00; D01D 10/0436; D01D 10/0463; D01D 11/06; D01D 13/00

See application file for complete search history.

(56) References Cited

U.S. PATENT DOCUMENTS 2,945,282 A * 7/1960 Freiberger ..... D01D 5/22 264/168
3,225,383 A * 12/1965 Cobb, Jr. ..... D01D 4/06 425/131.5

(Continued)

FOREIGN PATENT DOCUMENTS

| | | |
|---|---|---|
| EP | 1961847 A1 | 8/2008 |
| GB | 737222 | 9/1955 |

(Continued)

*Primary Examiner* — Joseph S Del Sole
*Assistant Examiner* — Joseph S Leyson
(74) *Attorney, Agent, or Firm* — Lucas & Mercanti, LLP

(57) ABSTRACT

The present invention relates to an extrusion head for generating filaments, extrusion installation and method using said extrusion head, the extrusion head comprising an inlet for the introduction by pressure of a solvent and polymer solution, and an extrusion plate provided with extrusion nozzles configured for forming filaments from the solvent and polymer solution, where the inlet is in fluid communication with a laminar chamber through which the solvent and polymer solution circulates to a peripheral chamber from which it is radially distributed into a central chamber in which the extrusion plate is arranged, and where the laminar chamber is in fluid communication with an excess solvent outlet, and the central chamber is in fluid communication with an excess solution outlet.

17 Claims, 9 Drawing Sheets

(56) References Cited

U.S. PATENT DOCUMENTS

| | | | | |
|---|---|---|---|---|
| 3,309,734 | A * | 3/1967 | Bynum | D01D 4/02 425/378.2 |
| 4,108,588 | A * | 8/1978 | Fritsch | B29B 7/7615 425/185 |
| 2013/0264733 | A1 | 10/2013 | Ichikawa et al. | |
| 2013/0292860 | A1* | 11/2013 | Fujiki | B01D 69/085 264/13 |
| 2014/0232036 | A1 | 8/2014 | Inada et al. | |

FOREIGN PATENT DOCUMENTS

| | | | |
|---|---|---|---|
| GB | 936758 | | 9/1963 |
| JP | 5692407 | B2 | 4/2015 |
| WO | 2013014576 | A1 | 1/2013 |
| WO | 2013050777 | A1 | 4/2013 |
| WO | 2014203880 | A1 | 12/2014 |

* cited by examiner

EXTRUSION HEAD FOR GENERATING FILAMENTS, EXTRUSION INSTALLATION AND METHOD USING SAID EXTRUSION HEAD

CROSS REFERENCE TO RELATED APPLICATION

This Application claims the priority of Spanish Patent Application No. 201530911 filed on Jun. 25, 2015, application which is incorporated herein by reference.

FIELD OF THE ART

The present invention relates to the manufacturing of filaments used for obtaining carbon fiber, proposing an extrusion head which allows obtaining an optimally oriented molecular structure in the extruded filaments, as well as an installation for manufacturing filaments having great flexibility and reduced dimensions. The invention is essentially aimed at the manufacturing of polyacrylonitrile (PAN) filaments, polyacrylonitrile (PAN) being the main precursor for manufacturing carbon fiber, although the application thereof to polymer of this type is not limiting, the invention being able to be applied for manufacturing filaments having another type of alternative precursors, such as lignin, polyolefins or other precursors with similar characteristics, for example.

STATE OF THE ART

The polyacrylonitrile (PAN) filament manufacturing process comprises a polymerization phase, a treatment for converting the PAN polymer into chippings, the preparation of a polymer solution and a spinning phase in which the prepared solution is extruded to form filaments that go through a coagulation step to form tows, which in turn go through post-coagulation, wet drawing, washing, drying and dry drawing steps, so that they can be finally collected on a reel or stored in boxes.

The PAN polymer is formed from the acrylonitrile (AN) monomer through free radical polymerization in aqueous suspension; a solvent in which the polymer can dissolve being used to obtain a precipitated polymer; the polymer being able to optionally contain other components, in addition to PAN, such as acrylic acid or itaconic acid, although if the PAN polymer is to be used as a carbon fiber precursor, it is desirable to reduce the presence of said other components as much as possible. However, the addition of said components provides greater processability in the next steps and is required.

Currently, polymer filaments can be manufactured by means of various spinning methods, such as melt spinning or molten polymer extrusion; dry spinning or extrusion of the solution formed by the polymer and the solvent in an environment in which the solvent evaporates and the polymer solidifies when hot air is being circulated; wet spinning or extrusion of the solution formed by the polymer and an organic or inorganic liquid, inside coagulation means; or dry-jet wet spinning or extrusion of the polymer solution in an air space, followed by a coagulation bath, for the purpose of favoring molecule orientation before coagulation. Among them, wet spinning and dry-jet wet spinning are the most widely used in the industry.

These methods involve pumping the polymer solution through the orifices of a plate, referred to as "spinneret", polyacrylonitrile filaments which are still not coagulated being formed. The plates usually have 400-450 orifices per square centimeter measuring 40-60 microns, in the cases of wet spinning, the surface density of the orifices being reduced a little and the diameter increasing up to 100-200 microns in the case of spinning with air chamber. The total number of orifices usually depends on the manufacturing process and on the desired final properties, but there are usually between 1,000 and 50,000 orifices for manufacturing carbon fiber precursor.

The PAN filament wet spinning process starts by dissolving the PAN polymer in a polar solvent, such as dimethylformamide, dimethylsulfoxide or aqueous sodium thiocyanate, the proportion of the PAN polymer typically being between 10% and 25% by weight. The molecular weight of the PAN polymer is usually in the range of 70000-200000, although the range of the molecule size can be even greater depending on the polymerization method used.

After extruding the polymer, the filaments go through a coagulation step where they start to gain consistency, and a post-coagulation step. Then, they undergo a wet drawing step in which their section is reduced. A subsequent washing step progressively eliminates the solvent from inside the filaments and substitutes it with water, for applying thereafter a coating on the filaments. Finally, they go through a drying step to eliminate the water contained therein and to collapse their structure, and a dry drawing.

In the coagulation step, the filaments are made to flow in a coagulant which must maintain the most homogeneous possible temperature and extracted solvent concentration to achieve maximum homogeneity among the many extruded filaments. Current wet spinning systems usually incorporate zones for the coagulant to access the filaments, being based on a residual circulation for reaching the filaments. In the post-coagulation step, the filaments are slightly drawn with draw ratios of about 1.1.

The mechanical properties of the final carbon fiber are closely related to the orientation of the polymer molecules forming the filaments. Today, the orientation is achieved in two steps of the manufacturing process: extrusion and drawing. In extrusion, when the polymer solution goes through the extrusion nozzles having a smaller diameter (40-60 microns), the polymer molecules are forced to orient themselves in the direction of extrusion and of the filament itself. Once coagulated, the filaments are brought to a wet drawing phase, in which they are drawn up to 650% with respect to their original dimensions. Drawing of the filaments are mainly performed in this phase, given that in this wet state in which the filaments still has the solvent therein, they can better withstand the drawing since the polymer molecules have greater freedom to move and slide.

After the wet drawing process, washing which eliminates the solvent from inside the filaments must be carried out using baths with demineralized water which gradually penetrates the filaments while the solvent leaves the filaments. The solvent concentration remaining in the filaments could lead to defects in the carbon fibers made in the future, so the final solvent concentration must be below 0.05%. Between 7-10 washing baths are usually used. Once the filaments have been almost completely depleted of the solvent, a silicone-based coating is applied thereon to prevent adhesion between the filaments or between the different tows.

Finally, after applying the coating, the filaments must be dried and the water contained therein must therefore be evaporated. This process is usually performed through a large number of heated rollers having medium dimensions (300-400 mm). With the filament once dry, the filaments are kept circulating through heated rollers similar to the drying rollers, but with a higher temperature which can reach 150° C., while an additional drawing known as dry drawing is applied thereto, using draw ratios of about 1.4. Improvement in the orientation is achieved in this step but it is significantly less with respect to wet drawing. The assembly of these two phases usually has a horizontal line of rollers having 40-60 rollers. After these steps, the filaments are collected either on reels or in boxes. The filaments are drawn about 1000% in total with respect to their initial geometry.

The continuous precursor manufacturing lines described above is usually arranged horizontally, covering dimensions greater than 80-100 m in length. The threading thereof is performed manually using tow guide systems in order to prevent the diversion of the filaments in the process.

Current industrial polyacrylonitrile filament manufacturing lines require large dimensions generally greater than 80-100 m, which means that there are extreme needs for space.

According to said concepts, there are several known solutions for manufacturing PAN polymer filaments, including, for example:

Patent document EP1961847 describing a PAN polymer filament production process, which comprises the wet or dry-jet wet spinning of the polymer with at least two drawing phases.

Patent document GB737222 describing a PAN polymer solution extrusion method for obtaining filaments, the extrusion being performed in an evaporative medium, along which the filaments travel and gradually lose their solvent content, going through several drawing phases thereafter.

Patent document GB936758 describing a method and an apparatus for performing the wet spinning of PAN polymer filaments, after a process of extruding the polymer through a spinneret having 100 orifices, with a extrusion rate of 3.1 cc/min.

Patent document JP5692407 describing a method for optimizing the process of mixing the solvent and PAN polymer solution, based on which it describes a polyacrylonitrile fiber manufacturing process and a carbon fiber manufacturing process using said solution.

Patent document WO2013/050777 describing a method for obtaining a PAN polymer based on using an organogel as precursor, containing not only polyacrylonitrile but also a nucleophilic polymer, and a dry-jet wet spinning process; wherein the PAN polymer is subjected to two drawing processes, one during coagulation and another after drying going through rollers and heating blocks.

Patent document WO2014/203880 describing a PAN polymer filament manufacturing method, with an additional drawing process in a pressurized steam chamber, preventing the fibers from breaking and the bundle of filaments from becoming fluffy.

Patent document US2013/0264733 describing a PAN polymer filament manufacturing method, with a hot drawing process by means of rollers, after drying, replacing the common drawing in an overheated steam chamber.

Patent document WO2013/014576 describing a PAN polymer filament manufacturing method, comprising a first PAN polymer spinning step and a second fiber oxidation/carbonization step, which are performed in line and in a continuous manner, the speed of the first step being low, in order to fit the fiber correctly to the second oxidation/carbonization step.

Patent document US 2014/0232036 describing a dry-jet wet spinning device in which there is introduced a system for suppressing vibrations in the coagulating liquid through a horizontal flow straightening plate surrounding the circumference of the bundle of filaments.

However, none of these solutions incorporates a step or series of steps prior to the extrusion process which are intended for improving molecular orientation, or systems to favor homogeneity in the properties of the coagulant in contact with the filaments in the coagulation step, or approaches which allow reducing the dimensions of the final line or providing greater flexibility to the production process.

OBJECT OF THE INVENTION

The invention proposes an extrusion head for generating filaments used for obtaining carbon fiber, and a method which allows optimizing the molecular orientation of the extruded filaments, as well as an installation incorporating said extrusion head.

The extrusion head for generating filaments of the invention comprises an inlet for the introduction by pressure of a solvent and polymer solution, and an extrusion plate provided with extrusion nozzles configured for forming filaments from the solvent and polymer solution. The inlet of the extrusion head is in fluid communication with a laminar chamber through which the solvent and polymer solution circulates to a peripheral chamber from which it is radially distributed into a central chamber in which the extrusion plate is arranged, where the laminar chamber is in fluid communication with an excess solvent outlet, and the central chamber is in fluid communication with an excess solution outlet.

Additionally the extrusion head comprises a storage tank provided with a polymer feed inlet, a solvent feed inlet, a solvent and polymer solution outlet in fluid communication with the inlet of the extrusion head, a solvent recovery inlet in fluid communication with the excess solvent outlet, and a solution recovery inlet in fluid communication with the excess solution outlet.

A first precision pumping system is arranged between the solvent and polymer solution outlet and the inlet of the extrusion head, a second precision pumping system is arranged between the excess solvent outlet and the solvent recovery inlet, and a third precision pumping system is arranged between the excess solution outlet and the solution recovery inlet.

There is arranged above the laminar chamber of the extrusion head a first floating plate provided with a filter which is secured by means of first elastic membranes, and attached to a first vibrator element, and there is arranged above the central chamber a second floating plate, which is secured by means of second elastic membranes, and attached to a second vibrator element, such that the vibrator elements aid in homogenizing the solution, favor the molecular orientation of the polymer and make extrusion of the filaments through the extrusion plate easier.

It has been envisaged that the filter of the first floating plate extends covering the entire lower portion of the first floating plate except the zone located above the inlet.

There is arranged above the first floating plate and the second floating plate a backpressure chamber provided with a compressed air inlet compensating for the pressure to which the chambers of the extrusion head are subjected.

The extrusion plate comprises at least 1000 extrusion nozzles arranged in a ring-shaped configuration, and preferably between 500,000 and 600,000, where each extrusion nozzle has a diameter between 50 and 500 microns, and preferably between 200 and 300 microns, the extrusion nozzles being spaced from one another by at least 1 mm.

With this arrangement of the extrusion head, the method for extruding filaments comprises introducing into the laminar chamber through the inlet of the extrusion head a solvent and polymer solution with a polymer concentration between 5% and 25% by weight, and preferably between 5% and 10%, removing the solvent from the laminar chamber through an excess solvent outlet until obtaining a solution with at least 20% by weight of polymer concentration, and preferably between 25% and 50%, directing the solution to a peripheral chamber from which it is radially distributed to a central chamber in which the solution is passed through the extrusion plate to form filaments, and removing the excess solution from the central chamber through an excess solution outlet.

The excess solvent in the laminar chamber leads to the polymer molecules of the solution having a great flexibility to move and to orient themselves in the direction of the flow, and the vibration induced by the vibrator elements aids in their orientation, as well as make homogenizing the solution easier and aid in reducing the pressure required for extruding the filaments.

The installation for manufacturing filaments comprises:

- an extrusion zone for extruding filaments in which there is arranged an extrusion head configured for extruding filaments through an extrusion plate,
- a coagulating and forming zone for coagulating the filaments and forming a tow of filaments,
- wet drawing zones and washing zones for wet drawing and washing the tow which are intercalated with one another,
- a finishing zone for finishing the tow,
- a drying zone for drying the tow,
- a dry drawing zone for dry drawing the tow, and
- a winding zone for winding the tow obtained.

The coagulating zone comprises a coagulating drum in which there is arranged an elongated body projecting vertically into the coagulating drum from the center of the extrusion plate, being arranged inside the bundle of extruded filaments, the elongated body being provided with air driving means and coagulant driving means configured for driving air and coagulant in a radial direction perpendicular to the filaments, and where the air driving means are arranged in the upper portion of the elongated body which is located outside the coagulating drum, and the coagulant driving means are arranged in the portion of the elongated body which is located inside the coagulating drum.

The coagulating zone additionally comprises an upper guide part for guiding the filaments which is attached to the lower end of the elongated body, a lower guide part which directs the filaments to a lower guide roller and is arranged immediately below the upper guide part, such that the filaments are brought from the extrusion plate to the lower guide roller through the upper and lower guide parts, causing the grouping of the filaments to form a tow of filaments having a planar configuration.

The coagulating drum is separated from the extrusion head a distance between 5 mm and 50 mm, and preferably between 20 mm and 30 mm, and configured for subjecting the filaments to an air stream.

A perimetral overflow connecting with a coagulant discharge collector is arranged outside the mouth of the coagulating drum.

Each wet drawing zone incorporates a set of draw rollers between which the tow passes and which are configured for rotating at different speeds and drawing the filaments of the tow, means for controlling the thickness of the filaments of the tow being arranged at the inlet and outlet of the wet drawing zone, and in that each washing zone incorporates a washing drum inside which there is submerged a guide roller for guiding the tow which is supported through a bearing column, the washing drums of the washing zones being attached at their upper portion by means of backwardly inclined flat bars which are arranged immediately below the sets of draw rollers.

The drying zone comprises stretch rollers for stretching the tow and drying rollers for drying the tow, wherein the drying rollers have a diameter of 1000 mm, and preferably a diameter between 1200 mm and 1800 mm, and incorporate heating means configured for maintaining the temperature of the stretch rollers between 100° C. and 120° C.

The dry drawing zone comprises vertically arranged draw rollers which are configured for rotating at different speeds, each roller having a protective cover for protecting the filaments and a temperature control system configured for maintaining the temperature of each draw roller between 100° C. and 180° C.

As a result of the molecular orientation of the polymer within the filament being supported by vibration, together with a homogeneous coagulation process, and as a result of the optimization of spaces, both provided by compacting the zones of the installation, an extrusion head and an installation having advantageous features for manufacturing filaments by means of extruding a polymer solution are obtained, being novel and preferred with respect to conventional systems having the same application.

DETAILED DESCRIPTION OF THE INVENTION

Figure 1:
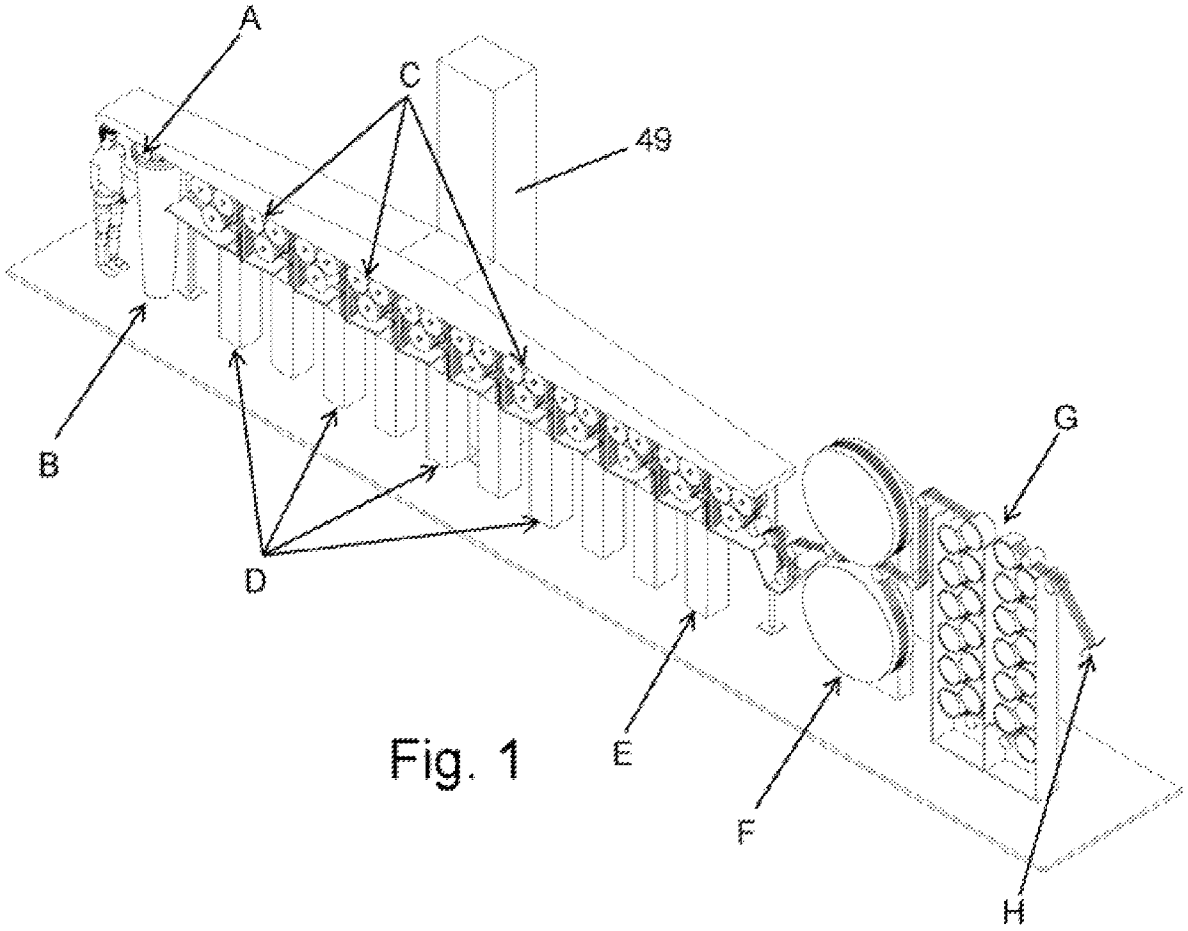
FIG. 1 shows a perspective view of the installation for manufacturing filaments of the invention.

FIG. 1 shows the installation for manufacturing filaments (1) of the present invention, for obtaining tows (2). The installation comprises a series of zones where the filaments (1) go through consecutively to receive the treatments required for obtaining a tow (2) of filaments (1) with the required features. The installation comprises an extrusion zone (A) for extruding filaments (1), a coagulating and forming zone (B) for coagulating the filaments (1) and forming the tow (2), wet drawing zones (C) and washing zones (D) for wet drawing and washing the tow (2) which are intercalated with one another, a finishing zone (E), a drying zone (F), a dry drawing zone (G) and a winding zone (H) for winding the tow (2) obtained.

Figure 3:
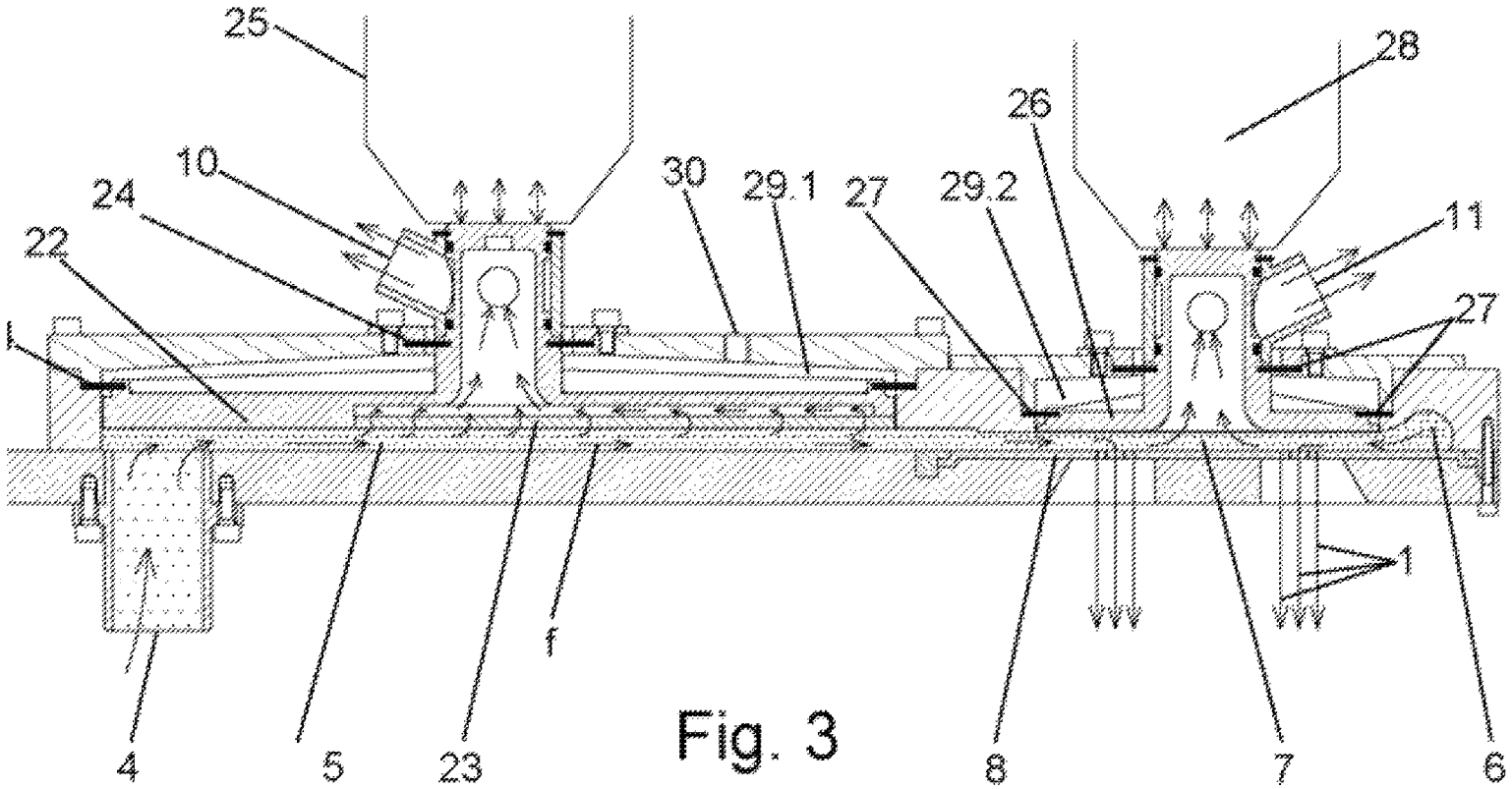
FIG. 3 shows a cross-section view of the extrusion head of the invention.
Figure 4:
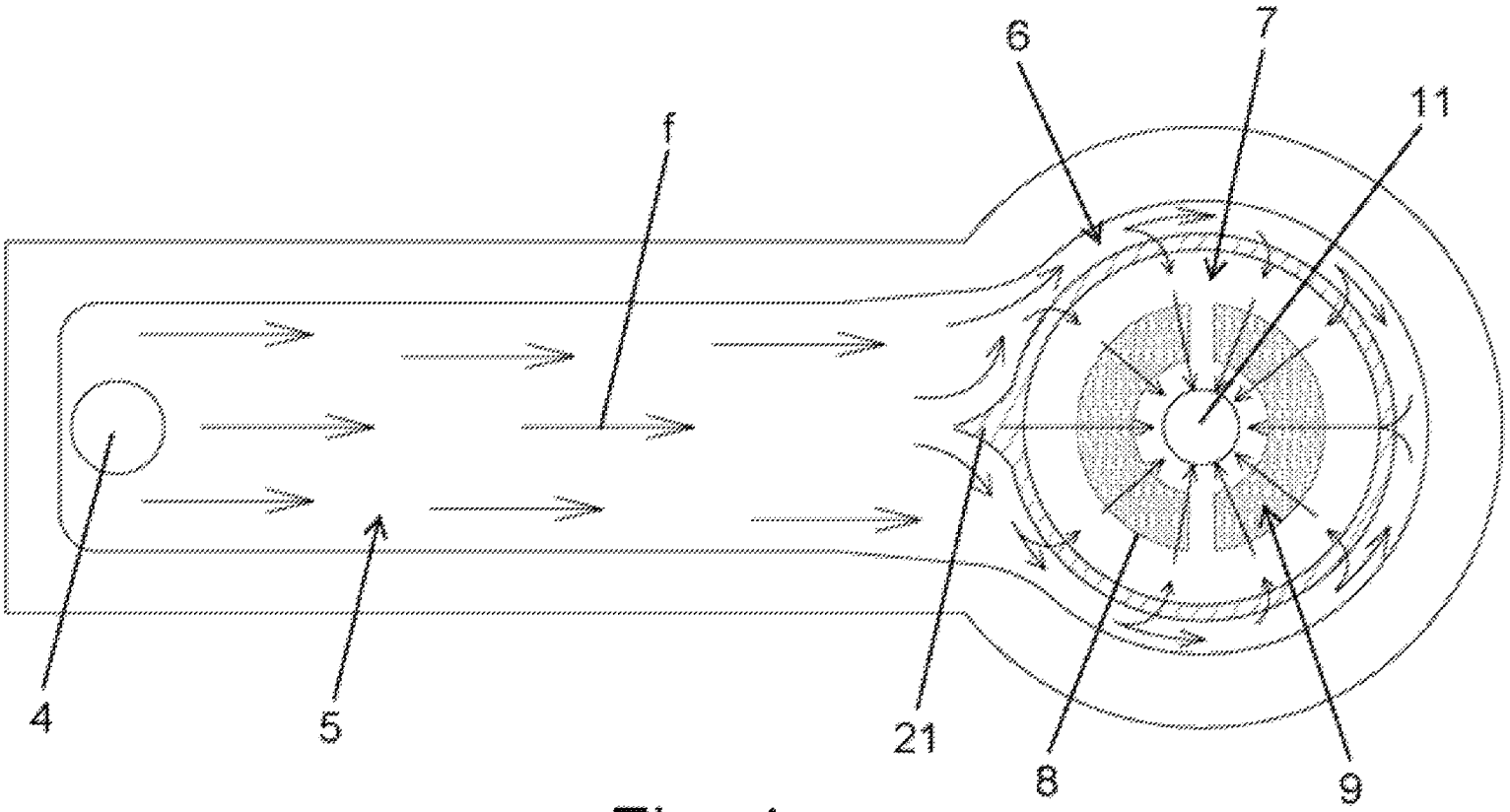
FIG. 4 shows another cross-section view of the extrusion head of the preceding figure in which the laminar flow direction of the solvent and polymer solution circulating inside the extrusion head is seen.

As seen in FIGS. 3 and 4, there is arranged in the extrusion zone (A) an extrusion head (3) for extruding filaments (1) comprising an inlet (4) for a solvent and polymer solution introduced by pressure, a laminar chamber (5) having a planar configuration through which the solution circulates, a peripheral chamber (6) which is in fluid communication with the inlet (4) through the laminar chamber (5), the solution being radially distributed from the peripheral chamber (6) into a central chamber (7) in which there is located an extrusion plate (8) provided with extrusion nozzles (9) in a ring-shaped configuration where the solution goes through for forming the filaments (1) that are directed to the coagulating zone (B).

The extrusion plate (8) incorporates at least 1000 extrusion nozzles (9), and preferably between 500,000 and 600,000 extrusion nozzles (9). It has been envisaged that the extrusion nozzles (9) have a diameter between 50 and 500 microns, and preferably between 200 and 300 microns, with a spacing between nozzles (9) of at least 1 mm.

The laminar chamber (5) is in fluid communication with an excess solvent outlet (10) configured for the forced removal of the excess solvent present in the solution circulating through the laminar chamber (5), whereas the central chamber (7) is in fluid communication with an excess solution outlet (11) configured for the forced removal of the excess solution not used for forming the filaments (1).

Figure 5:
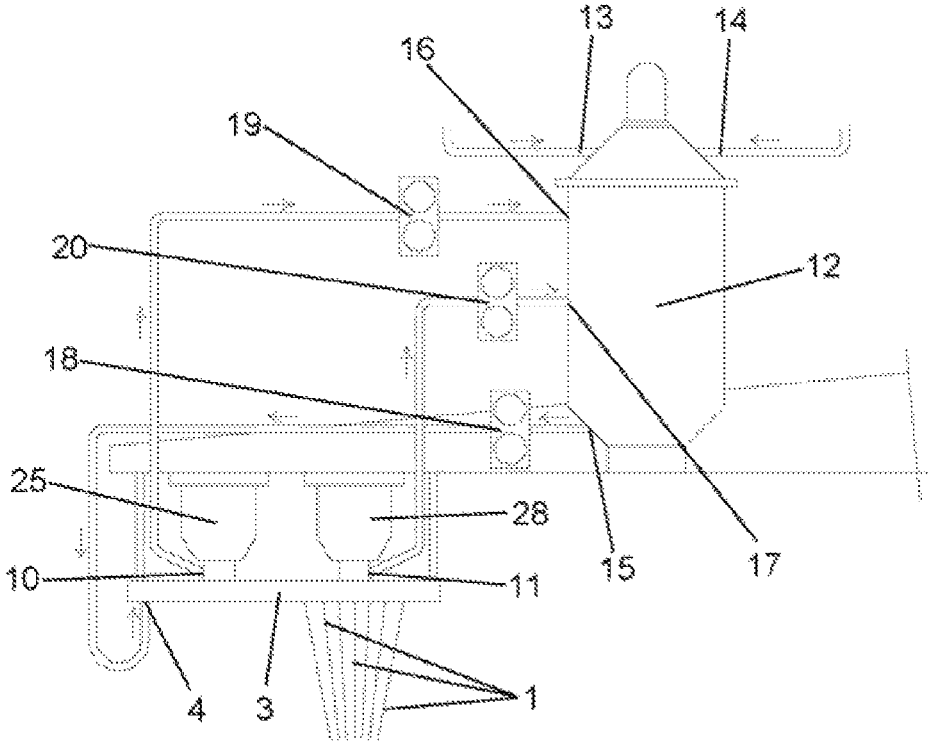
FIG. 5 shows a schematic view of the system for feeding the solvent and polymer solution to the extrusion head.

FIG. 5 shows a system for feeding the solvent and polymer solution to the extrusion head (3), comprising a storage tank (12) provided with a polymer feed inlet (13), a solvent feed inlet (14), a solvent and polymer solution outlet (15) which is in fluid communication with the inlet (4) of the extrusion head (3), a solvent recovery inlet (16) which is in fluid communication with the excess solvent outlet (10) of the extrusion head (3), and a solution recovery inlet (17) which is in fluid communication with the excess solution outlet (11) of the extrusion head (3).

The solvent and polymer solution is fed by pressure to the inlet (4) of the extrusion head (3) using a first precision pumping system (18) arranged in the fluid communication segment between the solvent and polymer solution outlet (15) of the storage tank (12) and the inlet (4) of the extrusion head (3). Likewise, the forced removal of the excess solvent from the extrusion head (3) is performed using a second precision pumping system (19) arranged in the fluid communication segment between the excess solvent outlet (10) of the extrusion head (3) and the solvent recovery inlet (16) of the storage tank (12), whereas the forced removal of the excess solution from the extrusion head (3) is performed using a third precision pumping system (20) arranged in the fluid communication segment between the excess solution outlet (11) of the extrusion head (3) and the solution recovery inlet (17) of the storage tank (12).

The storage tank (12) has a controller adapted for keeping a solvent and polymer solution homogeneous by means of the selective opening of the polymer feed inlet (13) and the solvent feed inlet (14). It has been envisaged that the solvent and polymer solution introduced in the extrusion head (3) has a polymer concentration between 5% and 25% by weight, and preferably between 5% and 10%. The temperature of the solution is kept constant in the extrusion zone between 30° C. and 80° C., and preferably between 50° C. and 70° C.

When the polymer introduced in the storage tank (12) is polyacrylonitrile (PAN), the main carbon fiber precursor, the polymer has been envisaged to have a molecular weight between 70.000 g/mol and 200.000 g/mol, and preferably between 100.000 g/mol and 140.000 g/mol. The solvent used is selected from the group consisting of dimethylsulfoxide or n,n-dimethylformamide.

With this arrangement, a polymer solution with surplus solvent is stored in the storage tank (12) to obtain a solution with a polymer concentration between 5% and 25% by weight, and preferably between 5% and 10%. This solution is injected at a pressure between 5 and 15 bar to the inlet (4) of the extrusion head (3) by means of the first precision pump (18). Due to the surplus solvent and the planar configuration of the laminar chamber (5), the polymer molecules present in the solution have great flexibility to move and orient themselves in the direction of the flow (f) of the solution in the laminar chamber (5).

Once the polymer molecules have oriented themselves, the excess solvent of the solution is removed from the laminar chamber (5) through the excess solvent outlet (10) of the extrusion head (3), for which the second precision pump (19) is used pumping the surplus solvent to the solvent recovery inlet (16) of the storage tank (12). With the removal of excess solvent, a solution with a polymer concentration of at least 20%, and preferably between 25% and 50%, is obtained in the laminar chamber (5), the viscosity of the solution thus increases, and it is assured that the polymer molecules do not become disorientated when they are passed through the peripheral chamber (6) and central chamber (7).

After removing the excess solvent in the laminar chamber (5), the solution is directed to the peripheral chamber (6), which incorporates at its inlet a flow deflector (21) forcing the solution to be distributed into the peripheral chamber (6) according to a circular path. Therefore, the solution is distributed around the perimeter until the peripheral chamber (6) is filled, after which, and as a result of overflowing, the solution is radially distributed into the central chamber (7) in which the extrusion plate (8) is located for forming the filaments (1). Due to the laminar nature of the flow (f) of the solution, the orientation of the polymer molecules is not affected in the event of changes in the direction of the flow (f) which occur in the passage between chambers (5, 6, 7). The excess solution not used for forming filaments (1) is removed from the central chamber (7) through the excess solution outlet (11), for which the third precision pump (20) is used pumping the surplus solution to the solution recovery inlet (17) of the storage tank (12).

Additionally, as seen in detail in FIG. 3, there is arranged immediately above the laminar chamber (5) a first floating plate (22), provided with a filter (23), which is secured at its ends to the structure of the extrusion head (3) by means of first elastic membranes (24), and attached at its upper portion to a first vibrator element (25). The filter (23) is particularly configured for removing solvent and possible air and gas remaining in the solution, largely or completely preventing the removal of polymer molecules from the solution. With this arrangement, the first vibrator element (25) produces a vibrating actuation on the first floating plate (22) which acts on the solution circulating through the laminar chamber (5) aiding in the molecular orientation thereof and favoring the removal of solvent through the excess solvent outlet (10).

As seen in FIG. 3, the filter (23) extends covering the entire lower portion of the first floating plate (22) except the zone located above the inlet (4). Therefore, a zone in which the polymer solution is confined between the first floating plate (22) and the laminar chamber (5) is defined at the height of the inlet (4), allowing the polymer molecules having the surplus solvent to be able to be oriented in the direction of the flow (f). The path left to be travelled by the solution through the laminar chamber (5) is confined between the filter (23) and the laminar chamber (5), starting the removal of the excess solvent and increasing the viscosity of the solution.

Likewise, and also additionally, there is arranged above the central chamber (7) a second floating plate (26), which is secured at its ends to the structure of the extrusion head (3) by means of second elastic membranes (27), and attached to a second vibrator element (28), which vibrates the second floating plate (26) supporting the alignment of the polymer molecules in the axial direction of the filaments (1) that are formed and making extrusion through the nozzles (9) of the extrusion plate (8) easier, so the driving pressure required in the solution to performing the extrusion is reduced.

It has been envisaged that the first and second vibrator elements (25, 28) are a mechanical vibrator or ultrasonic vibrator.

Since the chambers (5, 6, 7) are subjected to high pressure, approximately between 5 bar and 15 bar, a first backpressure chamber (29.1) is arranged above the first floating plate (22) and a second backpressure chamber (29.2) is arranged above the second floating plate (26), compressed air being introduced to both chambers (29.1, 29.2) through a compressed air inlet (30). FIG. 3 depicts a single compressed air inlet (30) for both backpressure chambers (29.1, 29.2), although independent compressed air inlets being able to be used for each backpressure chamber (29.1, 29.2). By means of the first and second elastic membranes (24, 27), the isolation of the laminar chamber (5), peripheral chamber (6) and central chamber (7) through which the solution circulates, the backpressure chamber (29) and the external atmosphere is assured.

In relation to the laminar chamber (5), peripheral chamber (6) and central chamber (7) providing electric or magnetic field generating means supporting the orientation of the polymer molecules of the solution in the direction of the flow (f) has been envisaged.

Once the filaments (1) have been extruded through the extrusion plate (8), they go to the coagulating zone (B) which is arranged immediately below the extrusion head (3), and in which the filaments (1) are joined to one another forming a bundle of filaments (1) or tow (2), the filaments (1) going from having a ring-shaped configuration to having a planar configuration.

Figure 6:
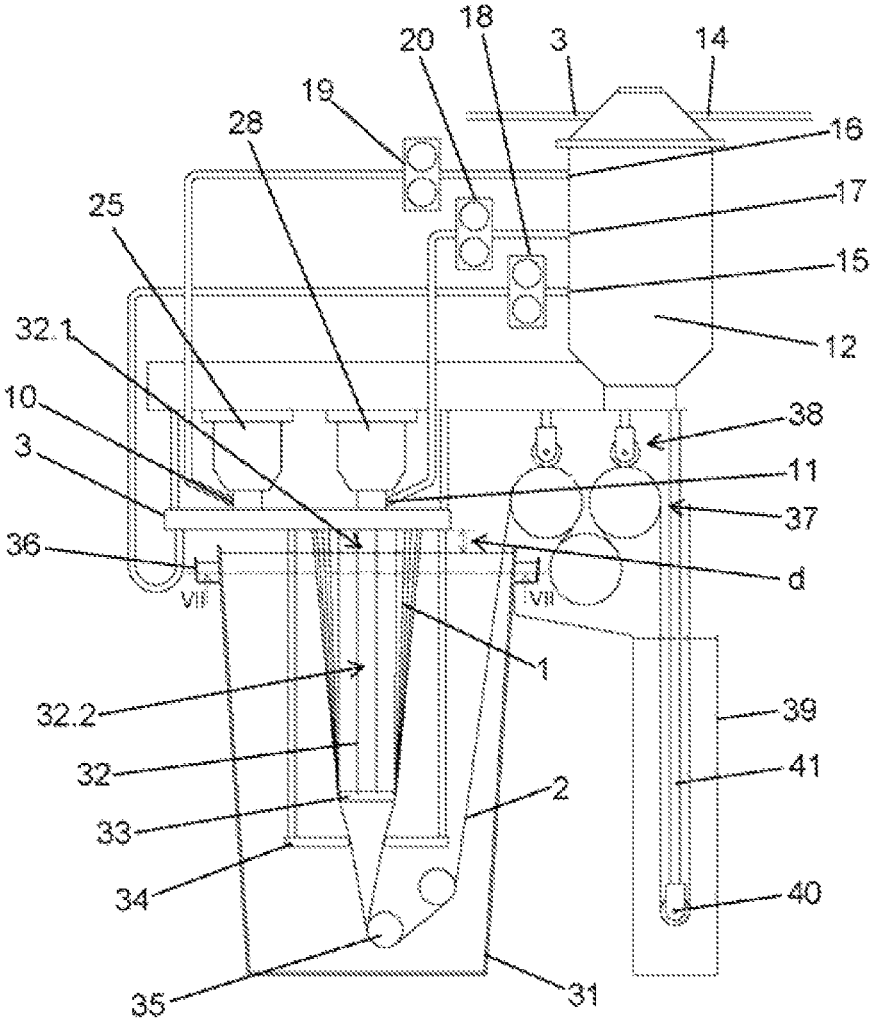
FIG. 6 shows a schematic view of the coagulating zone of the installation.

As shown in FIG. 6, the coagulating zone (B) comprises a coagulating drum (31) which is located immediately below the extrusion head (3) and contains a coagulant for the filaments (1) formed by a solvent and water solution at a temperature between 5° C. and 20° C., and preferably between 5° C. and 10° C. The coagulating drum (31) is separated from the extrusion head (3) a distance (d) between 5 mm and 50 mm, and preferably between 20 mm and 30 mm, a controlled air stream at a temperature between 5° C. and 50° C., and preferably between 15° C. and 25° C., is circulated through same, such that when the filaments (1) leaves the extrusion plate (8), they travel the distance (d) subjected to said forced air stream improving the conditions of the coagulation process.

There is arranged inside the coagulating drum (31) an elongated body (32) which is coupled at one of its ends to the extrusion head (3) and incorporates at its opposite end an upper guide part (33) for guiding the filaments (1), the elongated body (32) being located inside the ring shape in which the filaments (1) are extruded, there being arranged immediately below the upper guide part (33) a lower guide part (34) for guiding the filaments (1) leading the filaments (1) to a lower guide roller (35). The elongated body (32) is provided with air driving means (32.1) arranged in the upper portion of the elongated body (32) which is located outside the coagulating drum (31), and coagulant driving means (32.2) arranged in the portion of the elongated body (32) which is located inside the coagulating drum (31).

The coagulating drum (31) additionally incorporates a perimetral overflow (36) which is arranged externally surrounding the mouth of the coagulating drum (31) and is connected with a collector from which the surplus coagulant is discharged.

Figure 7:
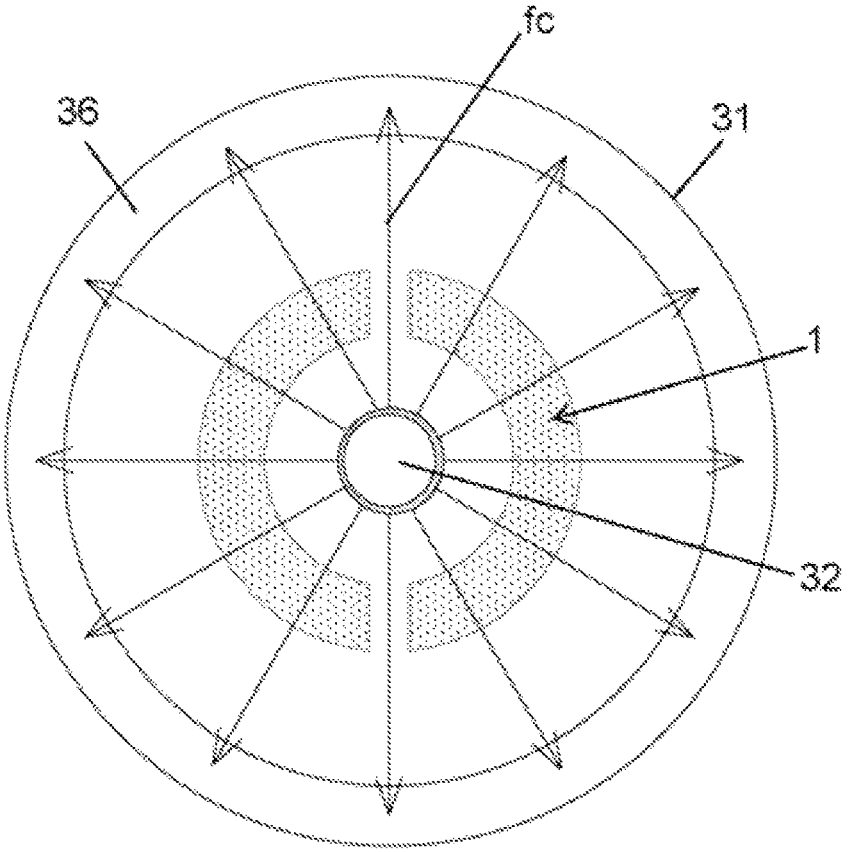
FIG. 7 shows a cross-section view of the coagulating drum through the zone referred to as VII in the preceding figure.

The elongated body (32) is coupled to the center of the extrusion plate (8) projecting vertically into the coagulating drum (1), such that the elongated body (32) is surrounded by the ring-shaped filaments (1) which are extruded through the extrusion nozzles (9) of the extrusion plate (8). With this arrangement of the elongated body (32), the air and the coagulant are driven in a radial direction (fc) perpendicular to the filaments (1), improving the coagulation conditions. FIG. 7 shows the perpendicular radial direction (fc) in which the air and coagulant are driven to the filaments (1). Furthermore, due to the ring-shaped configuration in which the filaments (1) are extruded, and the separation existing between each extruded filament (1), all the filaments (1) are thus treated in conditions having homogeneous temperature and coagulant concentration, therefore achieving homogeneity conditions that are way better than those of the already known filament coagulation processes.

The upper guide part (33) has an annular shape with a diameter smaller than the diameter of the ring shape in which the filaments (1) are extruded, whereas the lower guide part (34) has an annular hole having a diameter smaller than the upper guide part (33). With this configuration, the bundle of filaments (1) are dragged by the lower guide roller (34) passing along the outside of the upper guide part (33) and the inside of the hole of the lower guide part (34), such that the filaments (1) are joined together progressively until the ring-shaped filaments (1) are transformed into a tow (2) of filaments (1) having a planar configuration. With this arrangement of guide elements, a more homogeneous section of the filaments (1) is achieved and the possibilities of filaments crosslinking are reduced.

After the coagulating zone (B), the tow (2) of filaments (1) with the planar configuration is brought to wet drawing zones (C) and washing zones (D), in which the tow (2) is alternately subjected to drawing and to washing in water with a solvent at a temperature higher than 70° C., and preferably between 90° C. and 100° C.

Figure 8:
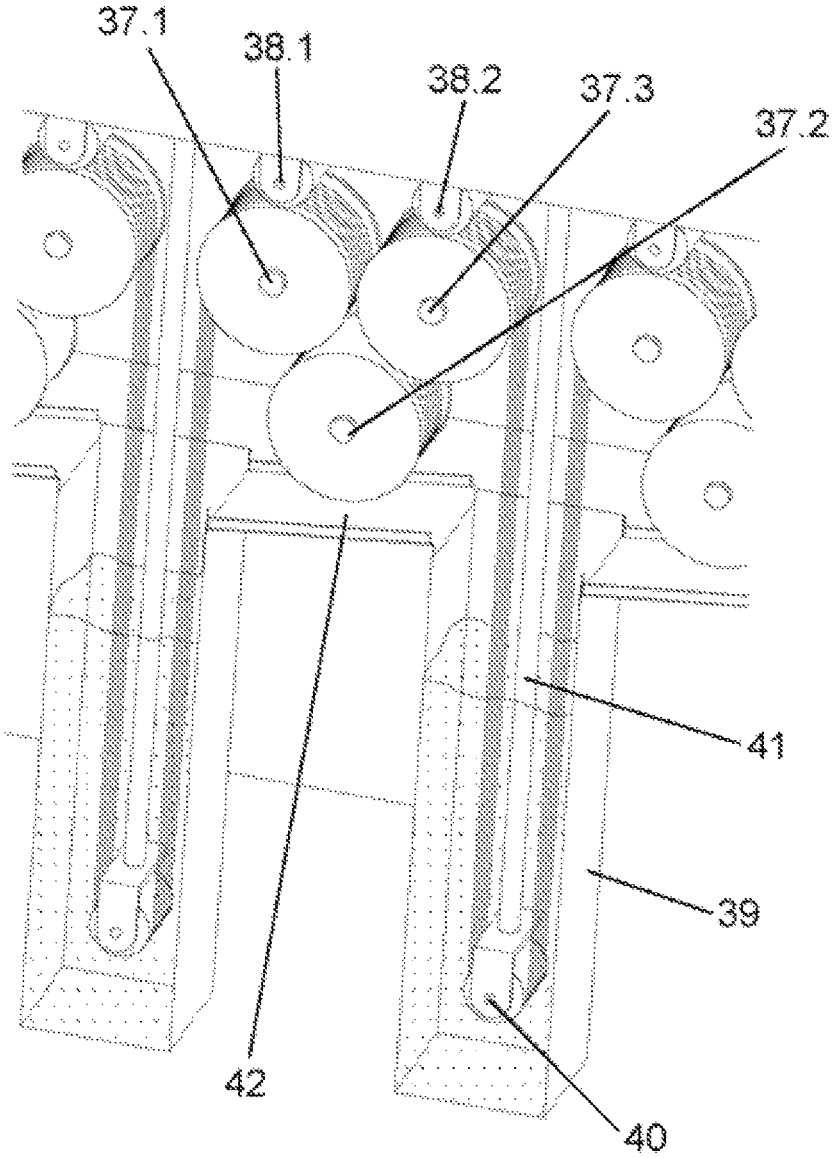
FIG. 8 shows a perspective view of a detail of the wet drawing zones and the washing zones of the installation.
Figure 9:
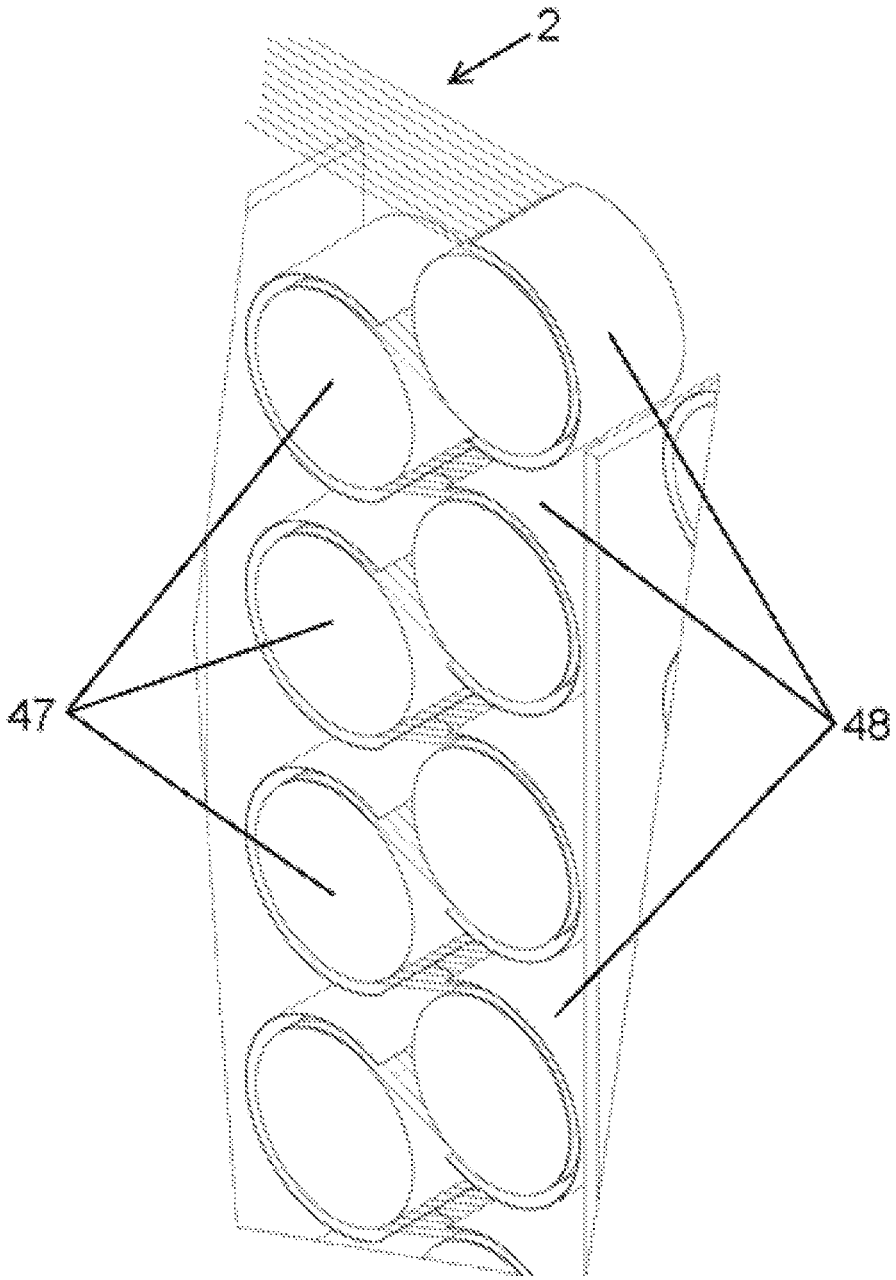
FIG. 9 shows a perspective view of a detail of the dry drawing zone of the installation.

Each wet drawing zone (C) incorporates a set of draw rollers (37) configured for rotating at different speeds in order to draw the tow (2) circulating between them. As seen in FIG. 8, using three draw rollers (37), formed by an inlet roller (37.1), an intermediate roller (37.2) and an outlet roller (37.3) has been envisaged. The wet drawing zone (C) incorporates means for controlling the thickness of the filaments (1) of the tow (2) before and after leaving the wet drawing zone (C). To that end, using rollers (38) provided with a position sensor by means of which the thickness of the filaments (1) of the tow (2) can be controlled before and after leaving the wet drawing zone (C) has been envisaged. Therefore, as seen in FIG. 8, a first roller (38.1) is arranged facing the inlet roller (37.1), and a second roller (38.2) is arranged facing the outlet roller (37.3), such that depending on the distance between the rollers the thickness of the filaments (1) of the tow (2) can be controlled.

Each washing zone (D) has a washing drum (39) inside which there is submerged a guide roller (40) for guiding the tow (2) which is supported through a bearing column (41).

In this manner, the tow (2) goes through the draw rollers (37), drawing the filaments (1), and is directed to the guide roller (40) of the washing drum (39) from which it goes back to the set of draw rollers (37) of the next washing zone (D), and so on and so forth until the required thickness of the filaments (1) of the tow is obtained. It has been envisaged that the installation preferably has nine wet drawing zones (C) and nine washing zones (D).

The washing drums (39) are attached to one another at their upper portion by means of backwardly inclined flat bars (42) which are arranged immediately below the set of draw rollers (37) for collecting possible remaining washing fluid droplets and directing them to the washing drum (39) arranged immediately before the drum from which the droplets originate. After the wet drawing zones (C) and washing zones (D), the tow (2) is directed to the finishing zone (E) in which a finishing drum (43) is arranged in a manner identical to the washing drums (39), in which a coating, preferably a silicon-based coating, is applied through immersing the tow (2) in a bath containing a silicon-based solution, tempered to a temperature between 40° C. and 70° C., after which the tow (2) will have a silicone coating less than 1% by mass, and preferably between 0.5% and 0.6% by mass.

It has been envisaged that the wet drawing zones (C), washing zones (D) and finishing zones (E) have a gas removal system for collecting all the possible discharges released during the process, either through local systems located in the washing drums (39) and finishing drum (43) and the sets of draw rollers (37), or through a general hood system.

After the finishing zone (E), the tow (2) is directed to the drying zone (F), in which stretch rollers (44) are arranged for stretching the tow (2), which stretch rollers (44) incorporate at their lower portion a flat bar (45) for collecting possible remaining droplets of the liquid used in the finishing zone (E). Immediately after the stretch rollers (44), the tow (2) is directed to drying rollers (46) having a diameter of at least 1000 mm, and preferably between 1200 mm and 1800 mm, which internally incorporate heating means. The heating means of the drying rollers (46) are controlled for maintaining a drying temperature between 100° C. and 120° C., all the heating rollers being able to use the same drying temperature, or different temperatures for progressively drying the tow (2). Using between two and four drying rollers (46) has been envisaged.

After the drying zone (E), the tow (2) is directed to the dry drawing zone (G), which comprises a series of draw rollers (47) configured for rotating at different speeds such that the filaments (1) of the tow (2) are progressively drawn. Likewise, the draw rollers (47) incorporate protective covers (48) to reduce the energy loses of the filaments (1).

The draw rollers (47) are placed in a vertical arrangement to optimize the plant space used in the dry drawing zone (G). It has been envisaged that each draw roller (47) incorporates an independent temperature control system for maintaining its temperature between 100° C. and 180° C.

Finally, the tow (2) is directed to the winding zone (H) in which the filaments (1) of the tow (2) are collected on reels for storage.

Figure 2:
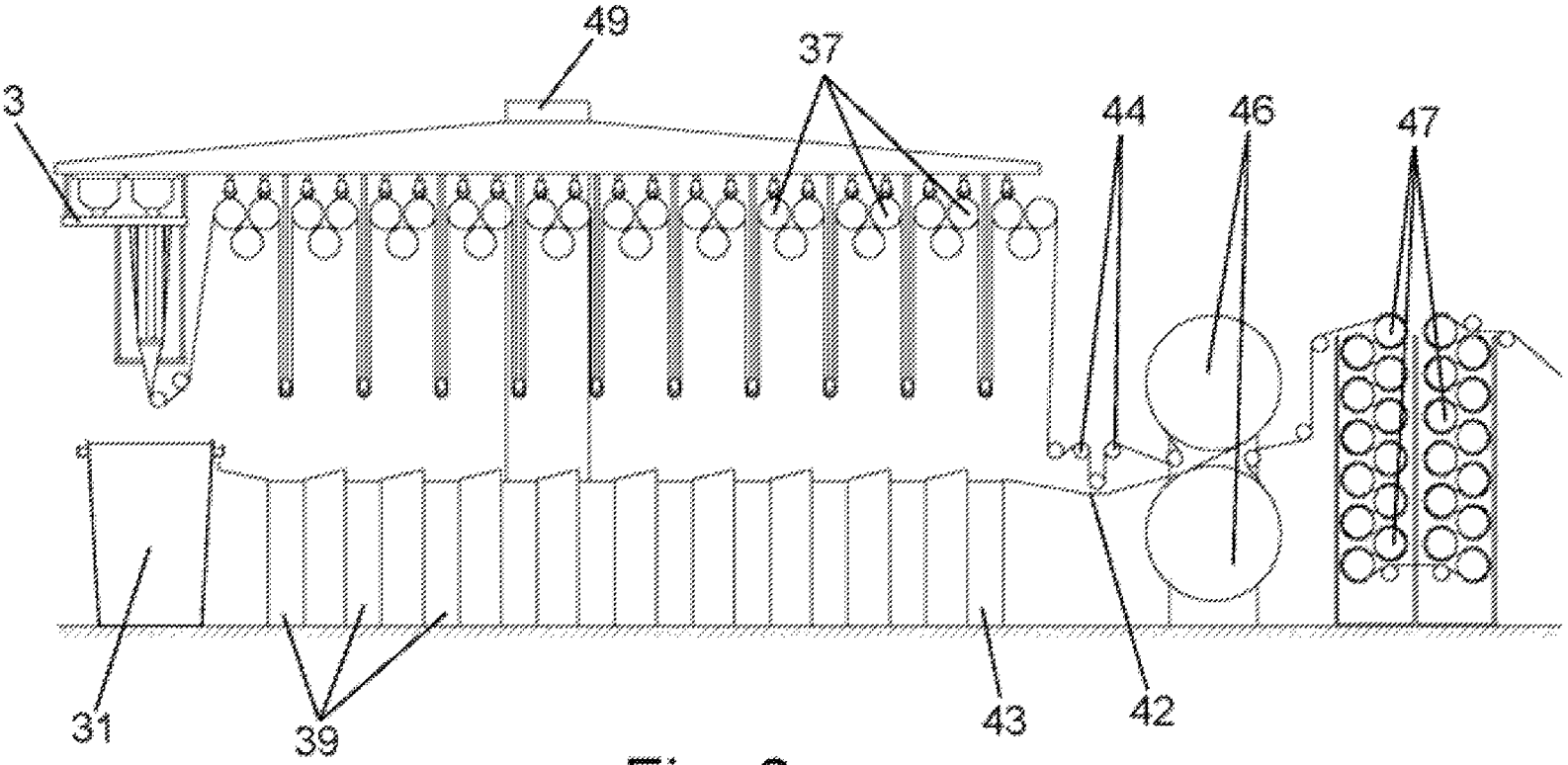
FIG. 2 shows a side view of the installation with its components lifted and separated from the coagulating, washing and finishing drums.

As seen in detail in FIG. 2, the upper portion of the installation can be vertically moved on a guide column (49) for separating the different components of the installation from the coagulating drum (31), washing drums (39) and finishing drum (43), such that the drums can be accessed to perform cleaning and/or maintenance tasks.

The invention claimed is:

1. An extrusion head for generating filaments, comprising an inlet for the introduction by pressure of a solvent and polymer solution, and an extrusion plate provided with extrusion nozzles configured for forming filaments from the solvent and polymer solution, wherein the inlet is in fluid communication with a laminar chamber through which the solvent and polymer solution circulates to a peripheral chamber from which it is radially distributed into a central chamber in which the extrusion plate is arranged, where the laminar chamber is in fluid communication with an excess solvent outlet, and the central chamber is in fluid communication with an excess solution outlet.

2. The extrusion head for generating filaments according to claim 1, wherein it additionally comprises a storage tank provided with a polymer feed inlet, a solvent feed inlet, a solvent and polymer solution outlet in fluid communication with the inlet, a solvent recovery inlet in fluid communication with the excess solvent outlet, and a solution recovery inlet in fluid communication with the excess solution outlet.

3. The extrusion head for generating filaments according to claim 2, wherein a first precision pumping system is arranged between the solvent and polymer solution outlet and the inlet, a second precision pumping system is arranged between the excess solvent outlet and the solvent recovery inlet, and a third precision pumping system is arranged between the excess solution outlet and the solution recovery inlet.

4. The extrusion head for generating filaments according to claim 1, wherein there is arranged above the laminar chamber a first floating plate, provided with a filter, which is secured by first elastic membranes, and attached to a first vibrator element, and in that there is arranged above the central chamber a second floating plate, which is secured by second elastic membranes, and attached to a second vibrator element.

5. The extrusion head for generating filaments according to claim 4, wherein the filter extends covering the entire lower portion of the first floating plate except in the zone located above the inlet.

6. The extrusion head for generating filaments according to claim 4, wherein a backpressure chamber provided with a compressed air inlet is arranged above the first floating plate and the second floating plate.

7. The extrusion head for generating filaments according to claim 1, wherein the extrusion plate comprises at least 1000 extrusion nozzles arranged in a ring-shaped configuration, wherein each extrusion nozzle has a diameter between 50 and 500 microns, the extrusion nozzles being spaced from one another by at least 1 mm.

8. An installation for manufacturing filaments, comprising:

an extrusion zone (A) for extruding filaments in which there is arranged an extrusion head according to claim 1, configured for extruding filaments through the extrusion plate, a coagulating and forming zone (B) for coagulating the filaments and forming a tow of filaments, wet drawing zones (C) and washing zones (D) for wet drawing and washing the tow which are intercalated with one another, a finishing zone (E) for finishing the tow, a drying zone (F) for drying the tow, a dry drawing zone (G) for dry drawing the tow, and a winding zone (H) for winding the tow obtained.

9. The installation for manufacturing filaments according to claim 8, wherein the coagulating zone (B) comprises a coagulating drum in which there is arranged an elongated body projecting vertically into the coagulating drum from the center of the extrusion plate, being arranged inside the bundle of extruded filaments.

10. The installation for manufacturing filaments according to claim 9, wherein the coagulating zone (B) additionally comprises an upper guide part for guiding the filaments which is attached to the lower end of the elongated body, a lower guide part which directs the filaments to a lower guide roller and is arranged immediately below the upper guide part, such that the filaments are brought from the extrusion plate to the lower guide roller through the upper and lower guide parts, causing the grouping of the filaments to form a tow of filaments having a planar configuration.

11. The installation for manufacturing filaments according to claim 9 wherein the coagulating drum is separated from the extrusion head a distance (d) between 5 mm and 50 mm, and configured for subjecting the filaments to an air stream.

12. The installation for manufacturing filaments according to claim 9, wherein a perimetral overflow connecting with a coagulant discharge collector is arranged outside the mouth of the coagulating drum.

13. The installation for manufacturing filaments according to claim 8, wherein each wet drawing zone (C) incorporates a set of draw rollers between which the tow passes and which are configured for rotating at different speeds and drawing the filaments of the tow, and in that each washing zone (D) incorporates a washing drum inside which there is submerged a guide roller for guiding the tow which is supported through a bearing column, the washing drums of the washing zones (D) being attached at their upper portion by backwardly inclined flat bars which are arranged immediately below the sets of draw rollers.

14. The installation for manufacturing filaments according to claim 8, wherein the drying zone (F) comprises a stretch rollers for stretching the tow and drying rollers for drying the tow, wherein the drying rollers have a diameter between 1000 mm and 1800 mm, wherein the stretch rollers are heated to a temperature between 100° C. and 120° C.

15. The installation for manufacturing filaments according to claim 8, wherein the dry drawing zone (G) comprises vertically arranged draw rollers which are configured for rotating at different speeds, each roller having a protective cover for protecting the filaments and a temperature control system configured for maintaining the temperature of each draw roller between 100° C. and 180° C.

16. An extrusion method for extruding filaments which uses an extrusion head for generating filaments according to claim 1 comprising:

introducing through the inlet of the laminar chamber a solvent and polymer solution with a polymer concentration between 5% and 25% by weight;

removing the solvent from the laminar chamber through the excess solvent outlet until obtaining a solution with at least 20% by weight of polymer concentration;

directing the solution to the peripheral chamber from which it is radially distributed to the central chamber in which the solution is passed through the extrusion plate to form filaments; and removing the excess solution from the central chamber through the excess solution outlet.

17. An extrusion method for extruding filaments which uses an installation for manufacturing filaments according to claim 8 comprising:

introducing through the inlet of the laminar chamber a solvent and polymer solution with a polymer concentration between 5% and 25% by weight;

removing the solvent from the laminar chamber through the excess solvent outlet until obtaining a solution with at least 20% by weight of polymer concentration;

directing the solution to the peripheral chamber from which it is radially distributed to the central chamber in which the solution is passed through the extrusion plate to form filaments; and removing the excess solution from the central chamber through the excess solution outlet.

* * * * *